US006675538B2

(12) United States Patent
Candio

(10) Patent No.: US 6,675,538 B2
(45) Date of Patent: Jan. 13, 2004

(54) AMUSEMENT MAZE

(76) Inventor: Stephen Candio, 31 NewStar Rd., Sparta, NJ (US) 07871-3024

( * ) Notice: Subject to any disclaimer, the term of this patent is extended or adjusted under 35 U.S.C. 154(b) by 0 days.

(21) Appl. No.: 09/800,882

(22) Filed: Mar. 7, 2001

(65) Prior Publication Data

US 2002/0170241 A1 Nov. 21, 2002

(51) Int. Cl.[7] ..... E04B 1/346

(52) U.S. Cl. ..... 52/65; 52/71; 52/238.1; 273/110; 273/111; 472/62

(58) Field of Search ..... 52/64, 65, 238.1, 52/239, 220.7, 243.1, 71; 472/62, 66, 77, 92, 94, 134; 273/110, 111

(56) References Cited

U.S. PATENT DOCUMENTS

| | | | | | |
|---|---|---|---|---|---|
| 462,094 | A | * | 10/1891 | Fowler | |
| 2,162,523 | A | * | 6/1939 | Blood et al. | |
| 2,976,923 | A | * | 3/1961 | Hirashiki | |
| 3,525,483 | A | * | 8/1970 | Van Alystyne | |
| 3,596,701 | A | * | 8/1971 | Cowan | 160/229 |
| 3,733,758 | A | * | 5/1973 | Maier et al. | 52/113 |
| 4,015,653 | A | * | 4/1977 | Slysh et al. | 160/213 |
| 4,148,163 | A | * | 4/1979 | Chenin et al. | 52/71 |
| 4,154,440 | A | * | 5/1979 | Rusk | 272/19 |
| 4,155,524 | A | * | 5/1979 | Marello et al. | 244/173 |
| 4,638,614 | A | * | 1/1987 | Wilcox | 52/238.1 |
| 5,064,720 | A | | 11/1991 | Kempo et al. | |
| 5,167,575 | A | * | 12/1992 | Macdonnald | 454/187 |
| 5,219,316 | A | * | 6/1993 | Huffman | 472/62 |
| 5,235,789 | A | * | 8/1993 | Rackowski | 52/239 |
| 5,265,853 | A | * | 11/1993 | Szirtes | 267/160 |
| 5,319,905 | A | * | 6/1994 | Szirtes | 52/108 |
| 5,364,311 | A | | 11/1994 | Chou | |
| 5,393,074 | A | * | 2/1995 | Bear et al. | 273/440 |
| 5,509,747 | A | * | 4/1996 | Kiendl | 403/102 |
| 5,809,708 | A | | 9/1998 | Greer et al. | |
| 5,855,371 | A | | 1/1999 | Sanders | |
| 5,906,373 | A | | 5/1999 | Sanders | |
| 5,971,830 | A | | 10/1999 | Tobin | |
| 6,095,927 | A | * | 8/2000 | Malone | 472/62 |

* cited by examiner

*Primary Examiner*—Carl D. Friedman
*Assistant Examiner*—Yvonne M. Horton
(74) *Attorney, Agent, or Firm*—Michael I Kroll

(57) ABSTRACT

The present invention 10 discloses an amusement maze. The maze of the present invention 10 can be located indoors and consists of a plurality of pivotal wall panels 16 whereby each panel may pivot to open a passage way or close a passage way creating a new maze pattern. Each wall panel unit consists of two pivotal panels 16 mounted to a pillar 18. Each unit is computer controlled and can flip the panels 16 back and forth by means of a servomotor 40 mounted to each pillar 18. When a plurality of units are joined together, they create cells 22. The cells 22 create the maze. Located within each cell 22 is a motion sensor 51, a voice-activated panic alarm 52, a hand-activated panic button 48 and direction lights 20 that may lead a player 12 to the nearest exit 24. All are safety features linked to the main monitor 62 and computer 60. The main computer 60 is located in a building out side of the maze in the attendant's room 58. The attendant's room 58 consists of the main computer 60 and monitor 62 used in the operation and reconfiguration of the maze and maze patterns. Located outside of the attendant's room 58 is a computer and monitor 64 for the player 12 that may reconfigure the maze pattern as per the user's request. The monitor 64 may show the progress a player 12 is achieving related to the maze challenge the player has chosen.

8 Claims, 9 Drawing Sheets

AMUSEMENT MAZE

BACKGROUND OF THE INVENTION

1. Field of the Invention

The present invention relates generally to amusement park games and more specifically to an amusement maze. The maze of the present invention can be located indoors and consists of a plurality of pivotal wall panels whereby each panel may pivot to open a passage way or close a passage way creating a new maze pattern. Each wall panel unit consists of two pivotal panels mounted to a pillar. The cell panels can be constructed of a variety of materials ranging from opaque to transparent. The heights of the individual cell panels can range from >half panels=that the user can see over so the whole maze is visible to higher than eye level, so that the user can see no further than the cells adjacent to and nearby the cell the user occupies. Each unit is computer controlled and can flip the panels back and forth by means of a servomotor mounted to each pillar. When a plurality of units are joined together, they create cells. The cells create the maze. The maze can be reconfigured from day to day or minute to minute, by changing the pivotal wall panel configuration and creating a new pattern. The number of cells joined together is variable. The more cells joined together the larger the maze. Located within each cell, a motion sensor, a voice activated panic alarm, a hand activated panic button and direction lights that may lead a player to the nearest exit. All are safety features linked to the main monitor and computer. The main computer is located in a building out side of the maze in the attendant's room. The attendant's room consists of the main computer and monitor used in the operation and reconfiguration of the maze and maze patterns. Located outside of the attendant's room is a computer and monitor for the player that may reconfigure the maze pattern as per the user's request. The monitor may show the progress a player is achieving related to the maze challenge the player has chosen.

2. Description of the Prior Art

There are other amusement mazes designed for game activities. Typical of these is U.S. Pat. No. 5,046,720 issued to Bolly on Sep. 10, 1991

Another patent was issued to Greer on Sep. 22, 1998 as U.S. Pat. No. 5,809,708. Yet another U.S. Pat. No. 5,855,371 was issued to Sanders on Jan. 5, 1999 and still yet another was issued on May 25, 1999 to Sanders et al. as U.S. Pat. No. 5,906,373.

Another patent was issued to Tobin et al on Oct. 26, 1999 as U.S. Pat. No. 5,971,830.

U.S. Pat. No. 5,046,720

Inventor: Timothy D. Bolly

Issued: Sep. 10, 1991

An amusement maze is located inside of a building and defines a labyrinth walking path. The maze is formed by upright flexible panels which are appropriately arranged in selected longitudinally and laterally extending patterns. The panels are supported by ropes anchored to a single sidewall of the building and are suspended above the floor of the building by wires which extend upwardly to the ceiling.

U.S. Pat. No. 5,809,708

Inventor: Ernest P. Greer

Issued: U.S. Pat. No. 5,809,708

An integrated prefabricated furniture is provided for finishing or fitting-out open plan building spaces, such as for offices, classrooms, hotels/motels, conference centers, medical treatment facilities, etc. A demountable architectural wall system covers the fixed walls of the building room, a portable partition wall system defines the interior space into individual work settings, and a demountable movable wall system forms custom width partitions. The three wall systems are completely compatible and fully integrated in both function and appearance, and provide similar utility raceways at common heights, as well as interchangeable cover panels. A modular column cover system selectively covers the support columns in the building room, and provides vertical utility routing and storage that integrates with the raceways in the wall systems. Pre-assembled facades, the freestanding storage case system, a space frame system, a prefabricated low raised floor construction, a modular overhead link head system, and accessories are disclosed and are designed to be used anywhere throughout the furniture system, and to serve to personalize the various individual work settings to accommodate specific users and tasks. Advantageously, the furniture system is readily reconfigurable.

U.S. Pat. No. 5,855,371

Inventor: Gary M. Sanders

Issued: Mar. 25, 1986

A water targeting game (10), known as WATER TAG.TM. The game (10) consists of three major elements: a targeting vest (12), a water gun (140) and an obstruction maze (142) wherein the game is played. The targeting vest (12) includes a front vest (14) and a back vest (16) that are joined together at their upper peripheral edge (26) by a pair of adjustable shoulder straps (70) and that are adjusted at a person's waist by a pair of waist straps (74,76). Between the two vests is a cavity (56) and on the front section (42) of the vest, is located a plurality of water collecting openings (58) that serve as targets. When playing the game, the water gun emits a stream of water that is aimed at the openings (58) from where the water falls into the cavity (56). The water collected in the cavities (56) is viewed through a sealed vertical window (62) that is also located on the vest's front section (42).

U.S. Pat. No. 5,906,373

Inventor: Gary M. Sanders

Issued: May 25, 1999

A WATER TAG.TM. game (10) that consists of a maze structure (14) having an outer perimeter wall (16) enclosing a plurality of sections (20,22,24,26) and protrusions (40). An opening (36) admits players armed with water guns (12) into the maze structure (14). Once inside the players circulate among the sections (20,22,24,26) and the protrusions (40), firing their water guns (12) at each other. The maze structure (14) is inflated when the WATER TAG.TM. game is being played and can be deflated for storage and transportation.

U.S. Pat. No. 5,971,830

Inventor: Adam Zev Tobin

Issued: Oct. 26, 1999

A constructable spinning top maze kit having a base upon which rail pieces may be removably mounted to form a maze through which the spinning top may travel when launched from a launcher. Multiple bases may be joined together in a single plane to create an indefinitely-extendable maze, or multiple bases may be assembled in multiple planes to create an indefinitely-extendable multi-level maze. Because rail pieces are removably mounted on the base pieces, a maze may be disassembled and reconstructed to form another maze have a completely different geometry, or one or more rail pieces may be repositioned to less drastically alter the geometry of the maze. As with the rail pieces, the launcher may be removably mounted on the base pieces. Therefore, the launcher may be positioned at a variety of locations in a maze, easily repositioned, and used within a variety of maze geometries. One or more pins may be placed on the base to provide a game with the objective of launching the top in a manner such that it will knock over the pins. The rail pieces may have downward-directed dowels with spacings which are integer multiples of a unit distance, and the base may have holes separated by the unit distance into which the dowels of the rail pieces may be inserted, thereby maximizing the number of rail configurations on the base.

While these amusement maze games may be suitable for the purposes for which they were designed, they would not be as suitable for the purposes of the present invention, as hereinafter described. It is thus desirable to provide an amusement maze which defines a walking path for challenging the skill of a person to find the proper path from an entrance to an exit. It is further more desirable to provide a maze that may constantly change its pattern by means of computer programs designed for that purpose.

SUMMARY OF THE PRESENT INVENTION

The present invention discloses an amusement maze. The maze of the present invention can be located indoors and consists of a plurality of pivotal wall panels whereby each panel may pivot to open a passage way or close a passage way creating a new maze pattern. Each wall panel unit consists of two pivotal panels mounted to a pillar. Each unit is computer controlled and can flip the panels back and forth by means of a servomotor mounted to each pillar. When a plurality of units are joined together, they create cells. The cells create the maze. Located within each cell, a motion sensor, a voice activated panic alarm, a hand activated panic button and direction lights that may lead a player to the nearest exit. All are safety features linked to the main monitor and computer. The main computer is located in a building out side of the maze in the attendant's room. The attendant's room consists of the main computer and monitor used in the operation and reconfiguration of the maze and maze patterns. Located outside of the attendant's room is a computer and monitor for the player that may reconfigure the maze pattern as per the user's request. The monitor may show the progress a player is achieving related to the maze challenge the player has chosen.

A primary object of the present invention is to provide an amusement maze for entertainment.

Another object of the present invention is to provide an amusement maze which defines a walking path for challenging the skill of a person to find the proper path from an entrance to an exit or final goal.

Yet another object of the present invention is to provide a computer controlled maze system consisting a program capable of a plurality of possibilities in maze patterns.

Still yet another object of the present invention is to provide pivotal wall panel units attached to a pillar and operating by a servomotor controlled by a main computer.

Yet another object of the present invention is to provide a wall panel unit that when joined together with other units create a cell. When a plurality of cells are joined together, they create a maze. The more cells assembled the larger and more versatile the maze. The maze can be constructed on one level (i.e., a ground floor) or multiple levels, two stories or more.

Additional objects of the present invention will appear as the description proceeds.

The present invention overcomes the shortcomings of the prior art by providing a maze network consisting of safety features such as a motion sensor, a voice activated panic alarm, a hand activated panic button and direction lights that may lead a player to the nearest exit.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
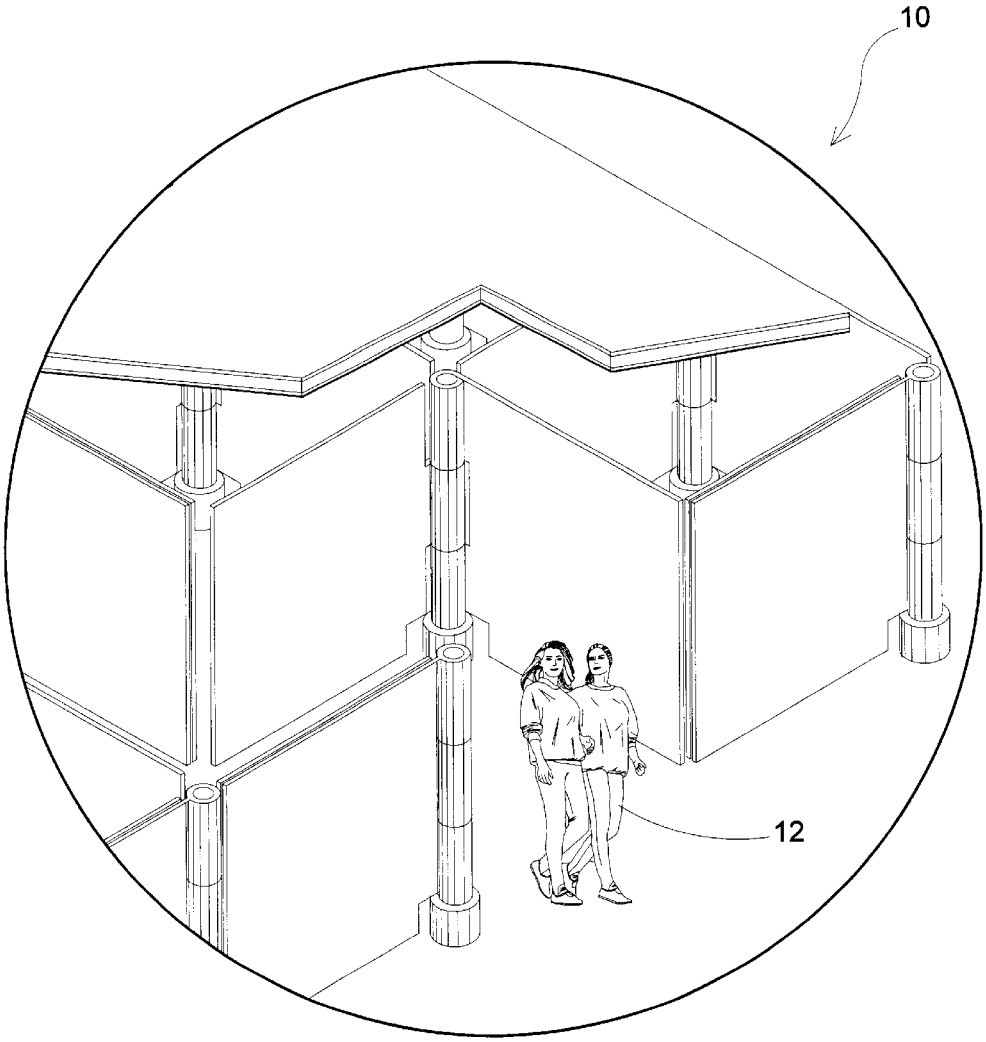
FIG. 1 is a pictorial illustration of the maze of the present invention. The maze can be reconfigured from day to day or minute to minute, by changing the pivotal wall panel configuration and creating a new maze pattern. Different degrees of maze solution difficulty can be created by reconfiguration of the maze cells. The maze can be presented as an endeavor of solo solution, group solution, time solution or competition solution for a plurality of users, either in sequential or simultaneous start. These potential uses are not to be considered exclusive and limiting, but rather examples of maze possible uses.

With regard to reference numerals used, the following numbering is used throughout the drawings.

| | |
|---|---|
| 10 | present invention |
| 12 | users |
| 14 | maze assembly |
| 16 | pivotal wall panels |
| 17 | hinge |
| 18 | pillar |
| 20 | exit lights |
| 22 | cell |
| 24 | exit |
| 26 | entrance |
| 28 | programming area |
| 30 | computer and power room |
| 32 | arrows |
| 34 | floor section |
| 36 | pivot pin |
| 38 | motor |
| 40 | servomotor |
| 42 | servomotor housing |
| 44 | insert rod |
| 46 | wiring harness |
| 48 | panic alarm |
| 50 | ceiling |
| 51 | motion sensor |
| 52 | voice activated alarm |
| 54 | wiring |
| 56 | wiring |
| 58 | attendant's room |
| 60 | main computer |
| 62 | attendant's monitor |
| 64 | customer computer and monitor |
| 66 | attendant's programmer |
| 68 | power source |
| 70 | attendant window |

DESCRIPTION OF THE PREFERRED EMBODIMENT(S)

In order that the invention may be more fully understood, it will now be described, by way of example, with reference to the accompanying drawings in which FIGS. 1 through 9 illustrate the present invention being an amusement maze.

Turning to FIG. 1, shown therein is a pictorial illustration of the maze of the present invention 10. The maze can be reconfigured from day to day or minute to minute, by changing the pivotal wall panel configuration and creating a new maze pattern. Different degrees of maze solution difficulty can be created by reconfiguration of the maze cells. The maze can be presented as an endeavor of solo solution, group solution, time solution or competition solution for a plurality of users 12, either in sequential or simultaneous start. These potential uses 12 are not to be considered exclusive and limiting, but rather examples of maze possible uses.

Figure 2:
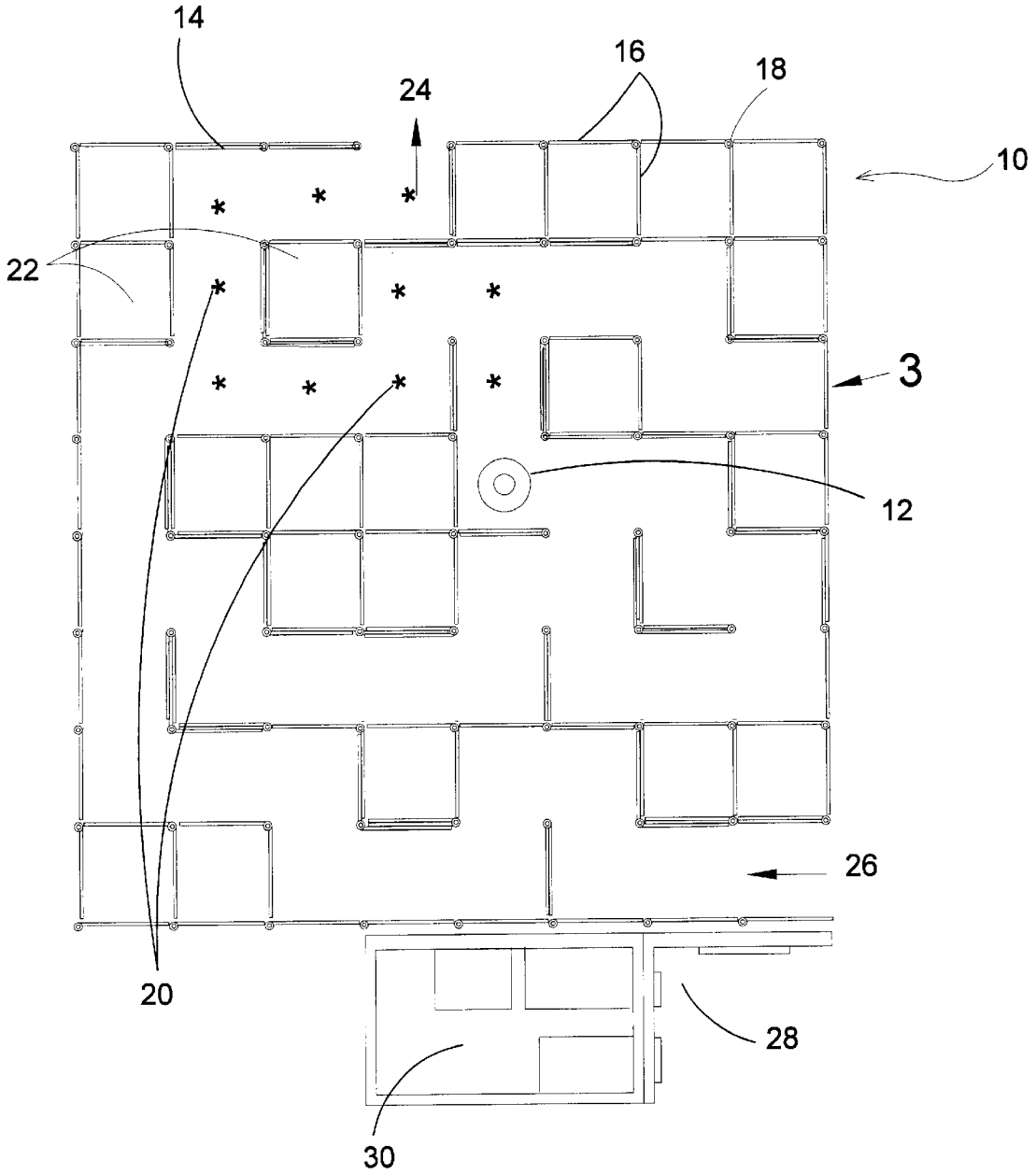
FIG. 2 is a top view of the present invention illustrating a possible maze pattern. Exit lights located above each cell may be activated to lead a player to an exit or final goal.

Turning to FIG. 2, shown therein is a top view of the present invention 10 illustrating a possible maze pattern. Each maze assembly 14 comprises a plurality of pivotal wall units 16 comprising two pivotal panels 16 pivotally mounted to a pillar 18. Exit lights 20 located above each cell 22 may be activated to lead a player 12 to an exit 24 or final goal. Also shown are an entrance 26, a programming area 28, and a computer and power room 30.

Figure 3:
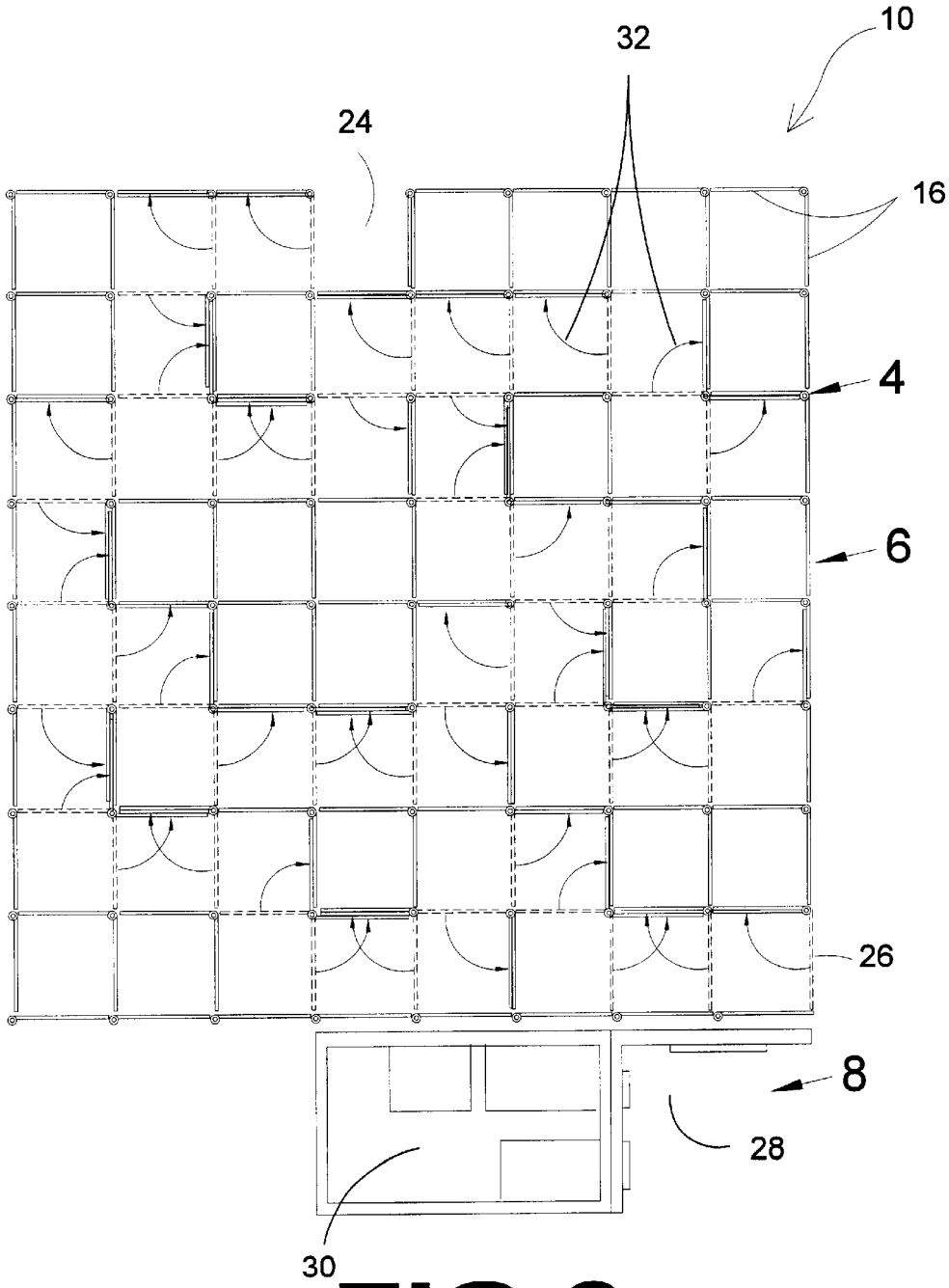
FIG. 3 is a top view of the present invention. The maze consists of a plurality of pivotal wall panels in which each panel may pivot to open a passageway or close a passageway creating a new maze pattern.

Turning to FIG. 3, shown therein is a top view of the present invention 10. The maze consists of a plurality of pivotal wall panels 16 in which each panel may pivot as shown by arrows 32 to open a passageway or close a passageway creating a new maze pattern. Other elements previously disclosed are also shown.

Figure 4:
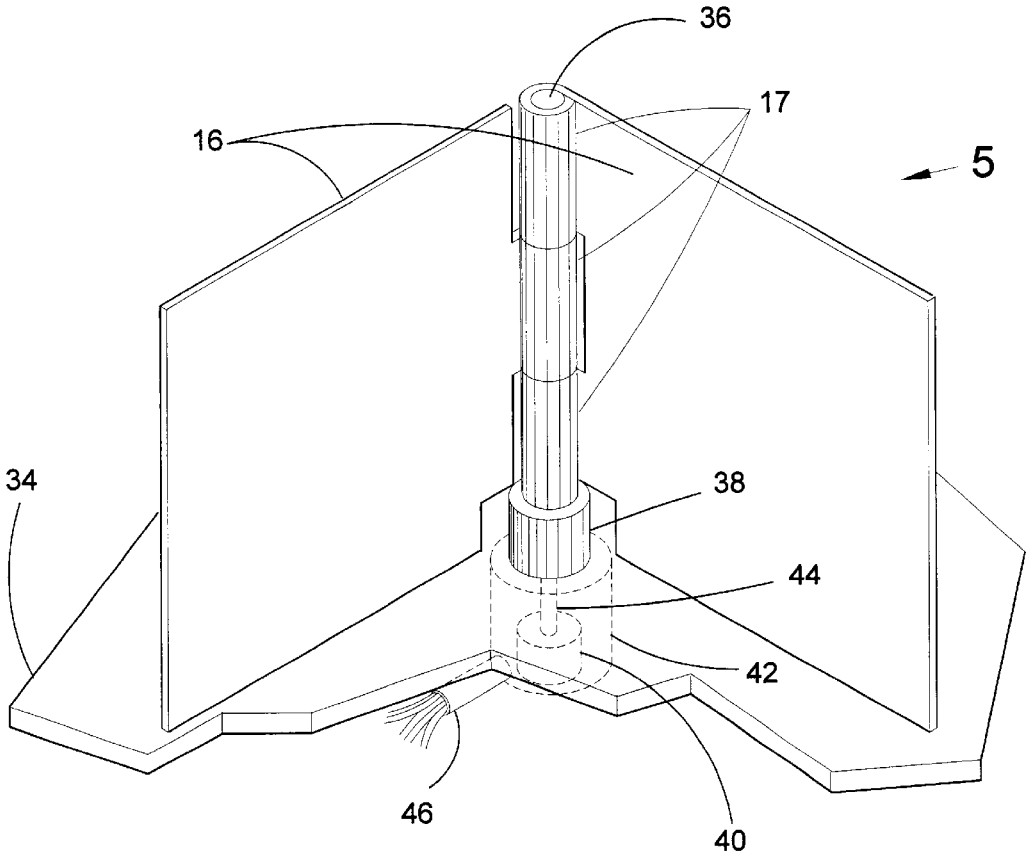
FIG. 4 is a perspective view of a pivotal wall panel unit. The maze consists of a plurality of pivotal wall panel units joined together to create cells.

Turning to FIG. 4, shown therein is a perspective view of a pivotal wall panel unit 16. The maze consists of a plurality of pivotal wall panel units 16 joined together to create cells by pivoting right or left to an open or closed position changing the path of the maze. Also shown are a floor section 34, a pivot pin 36, a wall hinge 17, a motor 38, a servomotor 40 with housing 42, an insert rod 44, and a wiring harness 46 to the computer and power source.

Figure 5:
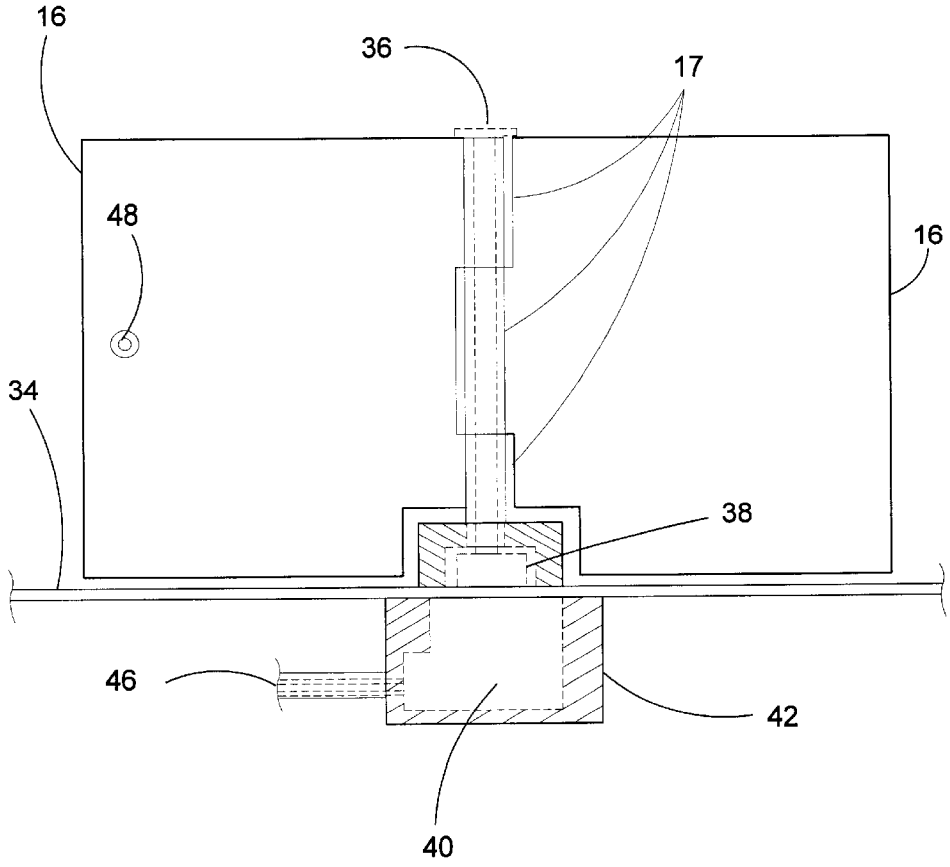
FIG. 5 is a sectional view of a pivotal wall unit.

Turning to FIG. 5, shown therein is a sectional view of a pivotal wall unit 16 along with a hand-activated panic alarm 48. Wall units 16 can be made to be shorter than the average user being about 4.5 feet in height, or, taller than the average being about 6.5 feet in height. Other elements previously disclosed are also shown.

Figure 6:
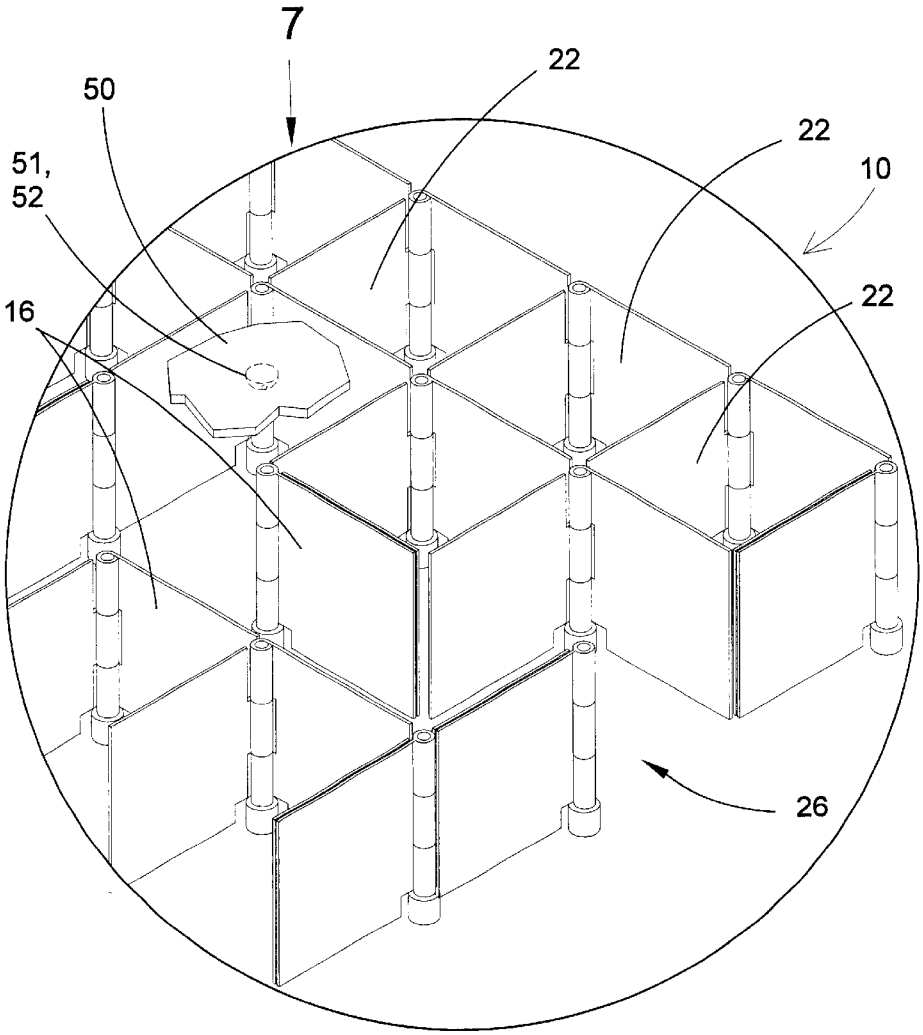
FIG. 6 is a pictorial view of a partial section of the maze of the present invention. Shown are a plurality of pivotal wall units assembled to form cells. The cells create the maze. Located above each unit is a movement sensor and a voice activated panic alarm. Located on a wall in each unit is a hand-activated panic button. If a problem should occur, lights located above each unit will guide the player to the nearest exit.

Turning to FIG. 6, shown therein is a pictorial view of a partial section of the maze of the present invention 10. Shown are a plurality of pivotal wall units 16 assembled to form cells 22. The multiple cells 22 create the maze. Located above each unit disposed on the ceiling 50 is a movement sensor 51 and a voice activated panic alarm 52. Located on a wall in each unit is a hand-activated panic button. If a problem should occur, lights located above each unit will guide the player to the nearest exit. An entrance 26 is also shown.

Figure 7:
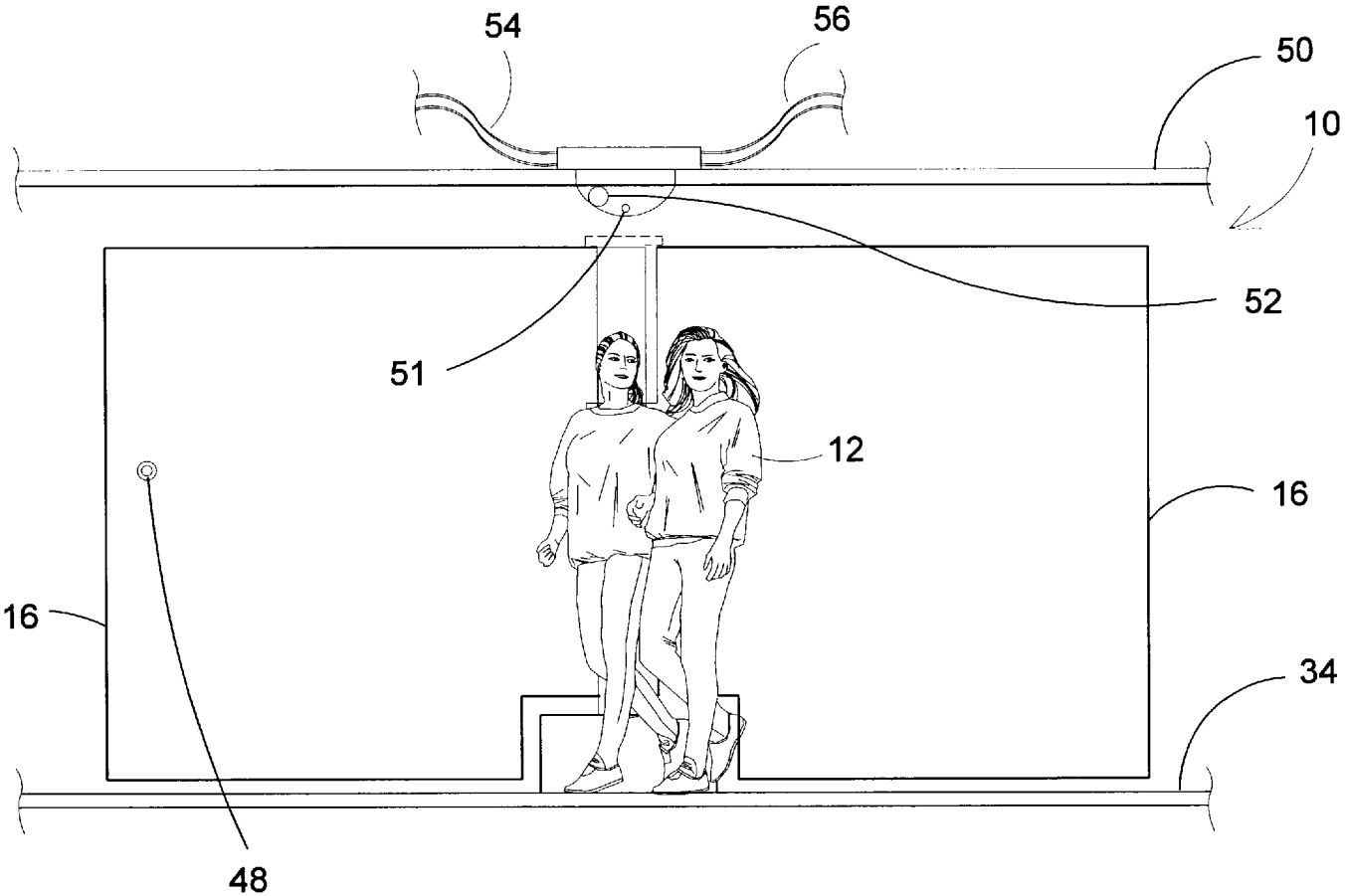
FIG. 7 is a frontal view of the maze of the present invention. Located above each unit is a movement sensor and a voice activated panic alarm. Located on a wall in each unit is a hand-activated panic button. If a problem should occur, lights located above each unit will guide the player to the nearest exit.

Turning to FIG. 7, shown therein is a frontal view of the maze of the present invention 10. Located above each unit is a movement sensor 51 and a voice activated panic alarm 52. Located on a wall 16 in each unit is a hand-activated panic button 48. If a problem should occur, lights located above each unit will guide the player 12 to the nearest exit. Also shown is wiring 54, 56 from sensors 51, 52 to the computer and power source, respectively. Other elements previously disclosed are also shown.

Figure 8:
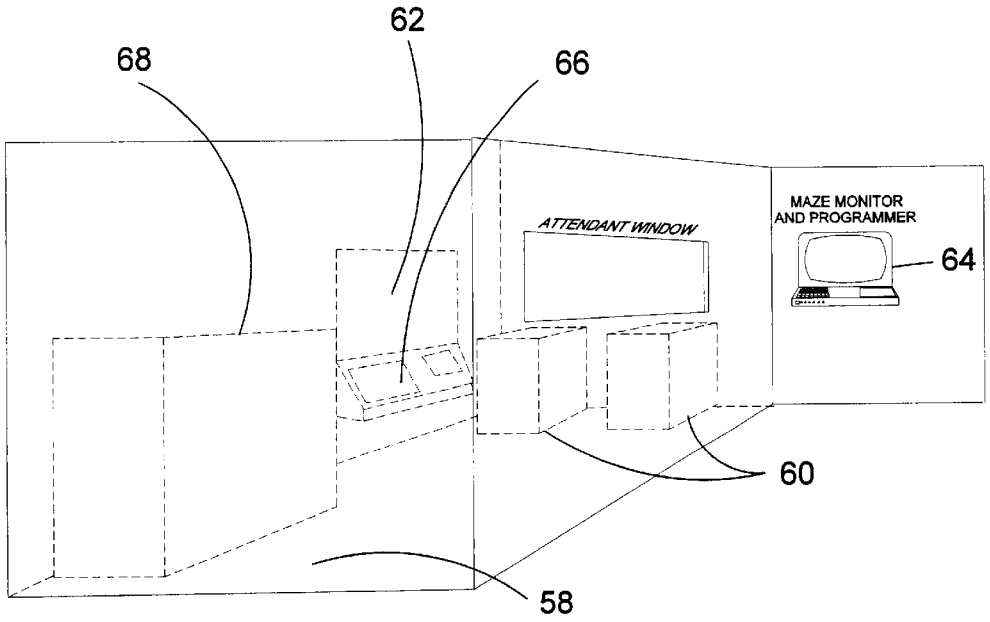
FIG. 8 is a perspective view of the attendant's room of the present invention. The attendant's room consists of the main computer and monitor used in the operation and reconfiguration of the maze and maze patterns. Located outside of the attendant's room is a computer and monitor used by a player and may reconfigure the maze pattern as per the user's request.

Turning to FIG. 8, shown therein is a perspective view of the attendant's room 58 of the present invention. The attendant's room 58 comprises the main computer 60, monitor 62, and programmer 66 used in the operation and reconfiguration of the maze and maze patterns. Located outside of the attendant's room 58 is a computer and monitor 64 used by a player which may reconfigure the maze pattern as per the users request. Also shown are a power source 68 and an attendant window 70.

Figure 9:
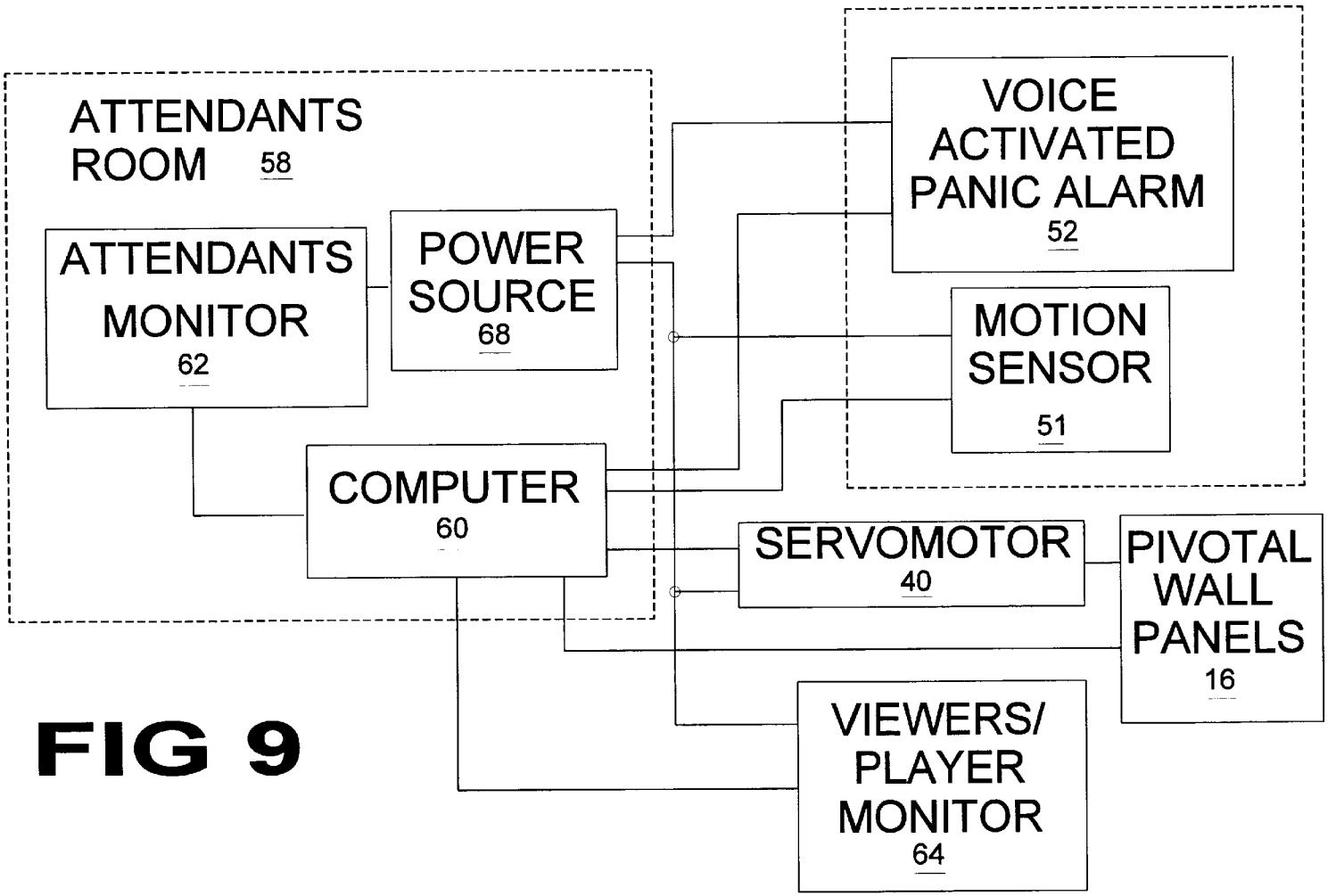
FIG. 9 is a block diagram of the present invention displaying the functions and operations of the maze.

Turning to FIG. 9, shown therein is a schematic block diagram of the present invention displaying the functions and operations of the maze. Elements previously disclosed are also shown.

What is claimed to be new and desired to be protected by Letters Patent is set forth in the appended claims.

I claim:

1. An apparatus for forming an indoor selectable maze for a user, comprising:

a) a plurality of transparent wall panels, wherein said wall panels are vertically disposed, said wall panels having at least one edge thereon;

b) a plurality of pivot pins, said edge of said wall panels being disposed on said pivot pins, said pivot pins being generally upright standing on a surface;

c) means for pivoting said wall panels about said pivot pins;

d) means for controlling the pivoting of said wall panels about said pivot pins, whereby said panels are selectably pivoted back and forth so as to form cells within a maze;

e) two wall panels are disposed on each pivot pin; and f) said means for pivoting said wall panels further comprising a hinge disposed on said edge of said wall panel, said pivot pin engaging said hinge, and motor means for pivoting said wall panel;

g) said means for controlling the pivoting of said wall panels about said pivot pins further comprises a main computer for operation by an attendant or user, a monitor for operation by an attendant or user, and a power source; and g) a motion sensor disposed in a cell for detecting a user.

2. The apparatus of claim 1, wherein the height of said wall is less than the height of an average user so that said user can see over said wall, said height being about 4.5 feet.

3. The apparatus of claim 1, wherein the height of said wall is greater than the height of an average user so that said user cannot see over said wall, said height being about 6.5 feet.

4. The apparatus of claim 1, further comprising a voice-activated panic alarm disposed in a cell for use by a user.

5. The apparatus of claim 4, further comprising a hand-activated panic alarm disposed in a cell for use by a user.

6. The apparatus of claim 5, further comprising a direction light disposed in a cell for use by a user.

7. The apparatus of claim 6, wherein said main computer is adapted to create multiple layouts of the maze.

8. The apparatus of claim 7, wherein said attendant's computer is adapted to create multiple layouts of the maze.

* * * * *